US007891028B1

(12) United States Patent
Camargo et al.

(10) Patent No.: US 7,891,028 B1
(45) Date of Patent: Feb. 22, 2011

(54) WATER-SAVING MANUAL TOILET FLAPPER VALVE

(76) Inventors: Anthony Camargo, 39125 Vista Dunes Rd., Rancho Mirage, CA (US) 92270; Rocky Caleb Camargo, 43780 Joshua Rd., Palm Desert, CA (US) 92260

( * ) Notice: Subject to any disclaimer, the term of this patent is extended or adjusted under 35 U.S.C. 154(b) by 0 days.

(21) Appl. No.: 12/462,246

(22) Filed: Jul. 31, 2009

(51) Int. Cl.
*E03D 1/35* (2006.01)

(52) U.S. Cl. ..... 4/393; 4/403; 4/404; 4/392

(58) Field of Classification Search ..... 4/392–394, 4/378, 385, 386, 403, 404
See application file for complete search history.

(56) References Cited

U.S. PATENT DOCUMENTS

| | | | | | |
|---|---|---|---|---|---|
| 2,731,646 | A | * | 1/1956 | Hughes | 4/393 |
| 2,767,406 | A | * | 10/1956 | Bennett | 4/392 |
| 2,810,915 | A | * | 10/1957 | Zinkil | 4/393 |
| 2,835,900 | A | * | 5/1958 | Gleason | 4/324 |
| 2,949,613 | A | * | 8/1960 | Svabek, Jr. et al. | 4/392 |
| 3,040,334 | A | * | 6/1962 | Corsaw | 4/400 |
| 4,364,129 | A | | 12/1982 | Schonger | |
| 4,499,616 | A | * | 2/1985 | Johnson | 4/393 |
| 4,536,900 | A | | 8/1985 | Hayes | |
| 4,945,580 | A | | 8/1990 | Schmitt | |
| 5,117,514 | A | | 6/1992 | Richter | |
| 5,129,110 | A | * | 7/1992 | Richter | 4/324 |
| 5,173,971 | A | * | 12/1992 | Schoepe et al. | 4/378 |
| 5,230,103 | A | * | 7/1993 | Antunez | 4/404 |
| 5,966,749 | A | * | 10/1999 | Goesling et al. | 4/392 |
| 6,173,457 | B1 | * | 1/2001 | Higgins | 4/393 |
| 2006/0195977 | A1 | * | 9/2006 | Shieh | 4/393 |

* cited by examiner

*Primary Examiner*—Khoa D Huynh

(57) ABSTRACT

An improved water-saving toilet flapper valve (20) that calls for an end to automatic toilet flushing; instead it is operated manually. By manually depressing the toilet flush handle (72) for a desired amount of time, the user regulates the amount of water flushed down the toilet in a single session, thus saving water. A short flush interval or full flush interval can be achieved. This is accomplished by designing the flange body (50) of the toilet flapper valve to house a solid inner core (54) containing a weighted mass (56). This allows the toilet flapper valve to become non-buoyant when submerged underwater in a toilet tank (60). The flange body design is an improvement on prior-art since it acts as a flange to create a positive seal with the valve seat (68) of the toilet tank; thus preventing water leakage. This improved toilet flapper valve design can replace a standard toilet flapper valve without the need of additional tools or costly modifications.

1 Claim, 3 Drawing Sheets

WATER-SAVING MANUAL TOILET FLAPPER VALVE

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field

The water-saving manual toilet flapper valve is a part of the field of toilet flushing systems and is a design that improves on the standard toilet flapper valve in that it conserves a significant amount of water by giving the user the ability to manually select how much water they use to flush the toilet.

2. Prior Art

A standard toilet system on the market today uses a flushing system with a very basic toilet flapper valve that is installed in the toilet tank portion of a toilet. The tank holds approximately 3 to 8 gallons of water when it is filled before it is automatically flushed away by a user. In order to flush a conventional toilet, a toilet flush handle must be depressed so that a linkage chain connected to the toilet flapper valve causes the toilet flapper to be pulled into an upwards position away from a valve seat located at the bottom of the toilet tank. This allows the water to quickly exit the tank and enter the toilet bowl. This quick transfer of water into the toilet bowl causes any waste product that was deposited into the toilet bowl to be flushed away into a collection system. Such collection systems include a septic tank or a sewage system. After the water is released, the toilet flushing system refills the toilet tank with water so that it will become available again.

One problem with conventional toilet flapper valves is that they do not allow for a manual flush. Once the toilet flush handle is depressed in a conventional automatic toilet flushing system, the toilet flapper valve opens and fills with air. It will remain floating in an upwards position due to the buoyancy of the toilet flapper valve's hollow body design. This forces the user to always flush the full contents of water in the toilet bowl each time the toilet flush handle is depressed. This equates to about 3 to 8 gallons of water being flushed away every time, no matter how little waste is deposited in the toilet bowl. This results in a large scale amount of water consumed each year by millions of people all around the world. Large amounts of clean water are therefore unnecessarily washed away with even the smallest of waste deposited in the toilet bowl.

Previously proposed weighted toilet flapper valve designs have shown to be unsuccessful since these designs have several inherent flaws. One of the major flaws of many proposed weighted toilet flapper valves is that they lack a protruding flange design. Lack of this flange design prevents the toilet flapper valve from creating a true positive seal with the valve seat of the toilet tank. Another inherent flaw of previous weighted toilet flapper valves is that they lack sufficient weighted mass in order to maintain a positive seal with the valve seat over time when toilet flapper valves are subject to warping. Insufficient mass will allow water to slowly drip through the seal of the toilet flapper valve and the valve seat, creating significant amounts of water loss and expenses. Overall, the problem with previously proposed weighted toilet flapper valve designs is that although many are labeled as "water-saving," the truth is that these toilet flapper valves compromise the idea of saving water since they are subject to water leakage over time as described above. An example of such a weighted design is U.S. Pat. No. 5,117,514 (issued to Robert Richter on Jun. 2, 1992).

3. Advantages

The water-saving manual toilet flapper valve is designed to conserve a considerable amount of water by using a solid inner core and a weighted mass retained securely within the inner core. The weighted mass and the solid inner core securing the weighted mass are both housed inside a flange body of the toilet flapper valve. The toilet flapper valve is reinforced with radially extending reinforcing fins attached to a rounded flat section of the toilet flapper valve. The reinforcing fins allow the rounded flat section to remain flat, thus preventing the toilet flapper valve from warping. As an added benefit the reinforcing fins help support the weight of the toilet flapper valve.

There are no air pockets contained in this improved toilet flapper valve design. The solid inner core coupled with the weighted mass results in a toilet flapper valve that has a non-buoyant body design. This non-buoyant design does not force the toilet flapper valve to remain in the upward position when the toilet flush handle is depressed. Instead, the toilet flapper valve will sink toward the valve seat when the toilet flush handle is released. This allows the user to manually select how much water is being flushed away by depressing the toilet flush handle for a desirable amount of time; more specifically, a short flush interval is used for liquid waste, and a full flush interval for solid waste.

The user will be in control of how much water they use for each flush. This will not only save the user on water costs but in turn will equate to a huge impact in water conservation. It is estimated that flushing toilets alone account for up to 40% of a family's water bill alone. This improved toilet flapper valve design will greatly reduce these water costs. This improved flapper valve design will also directly impact users with septic tank systems. The user will save time and money on costly septic tank pumping and maintenance since less water is used for every toilet flush. This adds up to significant savings in water and costs every year.

The water-saving manual toilet flapper valve improves upon previous weighted toilet flapper valve designs by allowing the flapper body to make a positive seal with the valve seat of the toilet bowl. This prevents any water leakage from occurring. The flange body design of the water-saving manual toilet flapper valve acts as a flange to create a strong positive seal with the valve seat. This improved toilet flapper valve design is also heavier than previous weighted flapper designs, which also helps create a leak-proof seal that will not leak or warp over time.

SUMMARY

The water-saving manual toilet flapper valve is designed to allow a user to select how much water is used to flush the toilet in a single flush. This feature of "manual flushing" improves upon the design of conventional toilet flapper valves since it not only gives the user freedom to make a partial toilet flush in addition to a full toilet flush, but its main goal is to save a significant amount of water each year by the average family and consumer. This in turn will help users save on their water bill and will prevent water backup in sewers and septic tanks. It will give users the empowerment to conserve water and help the environment. This idea of water conservation can also coincide with the existing "Go Green" campaign being utilized throughout the United States in order to educate people with environmental conservation. One way this improved flapper can be linked to the "Go Green" campaign is by manufacturing the toilet flapper valve using a green injection mold compound that gives the entire toilet flapper valve a green color. This will distinguish it from conventional colored toilet flapper valves, although the toilet flapper valve does not have to be limited to this single color.

The water-saving manual toilet flapper valve is designed to install in an existing toilet flushing system by directly replacing a conventional toilet flapper valve. No modifications or extra tools are necessary to install this improved toilet flapper valve. The water-saving manual toilet flapper valve employs a manual flushing technique to allow the user to select how much water is flushed away. This is unlike conventional automatic toilet flapper valves which use a buoyant body design to force the toilet flapper valve to remain in an upright position until a full toilet flush is achieved. The water-saving manual toilet flapper valve instead uses a non-buoyant design. The non-buoyant design allows the toilet flapper valve to sink quickly to its closed position in the toilet tank water when the toilet flush handle is released by the user. This gives the user freedom to use a partial toilet flush if desired.

Housed inside the flange body of the water-saving manual toilet flapper valve are a solid inner core and a weighted mass securely retained within the solid inner core. This solid inner core allows the toilet flapper valve to become non-buoyant in the toilet tank water. The weighted design of the toilet flapper valve allows it to sink quickly in the toilet tank water to its closed position whenever the toilet flush handle is released by the user.

With this non-buoyant weighted design, the user must keep the toilet flush handle depressed in order to keep the toilet flapper valve in the upright position. This allows water to pass through the toilet tank and into the toilet bowl. Once the toilet flapper valve is released, it quickly lowers to the closed position which stops the flow of water into the toilet bowl. This manual control of the toilet flapper valve gives the user complete control of how much water is expelled every time he or she flushes the toilet. This is unlike conventional toilet flapper valves which force the user to always flush a full toilet tank of water every time the toilet flush handle is depressed, regardless of the amount of waste that is deposited in the toilet bowl. The water-saving manual toilet flapper valve will conserve a significant amount of water with every flush.

The water-saving manual toilet flapper valve is also designed to prevent any water leakage by creating a positive seal with the valve seat of the toilet tank. Three features of this improved toilet flapper valve give it this leak-proof design. First, the toilet flapper valve is designed with a large rounded flat section that extends past the diameter of the valve seat. Second, when the toilet flapper valve is in the lowered position, the flange body of the toilet flapper valve will acts as a flange extending into the exit tube of the toilet tank. This creates a positive seal between the bottom of the toilet flapper valve and the top of the valve seat and exit tube. Third, the total weight of the toilet flapper valve forces it against the bottom of the toilet tank. This helps to create a true leak-proof seal with no warping. The use of all three anti-leak measures makes the design of the water-saving manual toilet flapper valve a huge improvement on previous weighted toilet flapper valve designs.

DETAILED DESCRIPTION

Figure 6:
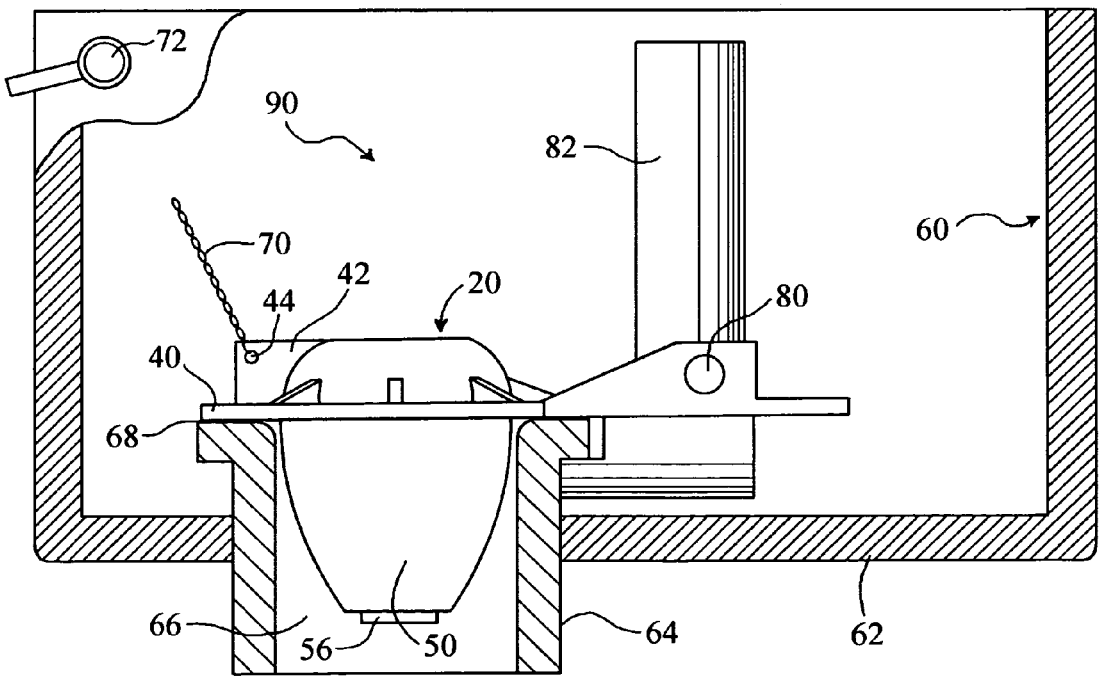
FIG. 6 is a front orthogonal view of a toilet tank containing a basic toilet flushing system with the water-saving manual toilet flapper valve installed.

The water-saving manual toilet flapper valve 20 (FIGS. 1-6) is designed to directly replace a standard toilet flapper valve installed in an existing conventional toilet flushing system 90. The toilet flushing system 90 is housed in a standard toilet tank 60 (FIG. 6). Located at the bottom portion 62 of the toilet tank 60 is a toilet tank drain 66 which directs water out the toilet tank 60 by way of an outlet pipe 64.

The toilet flapper valve 20 is operated by a toilet flush handle 72 (FIG. 6). The toilet flush handle 72 is connected to the toilet flapper valve 20 by means for attaching which includes a metal chain or similar linkage 70 via an attachment point 44 on a protruding tab portion 42 of the toilet flapper valve 20. When the toilet flush handle 72 is depressed, the toilet flapper valve 20 rises in the open position whereby the water in the toilet tank 60 flows down into the tank drain 66 and into a toilet bowl (not shown). This results in the waste products being flushed from the toilet bowl into a septic tank or sewer system (not shown). The toilet flush handle 72 must be depressed in order to keep the toilet flapper valve 20 in the upright position, thus allowing the user to manually control how much water is flushed away every time.

Figure 1:
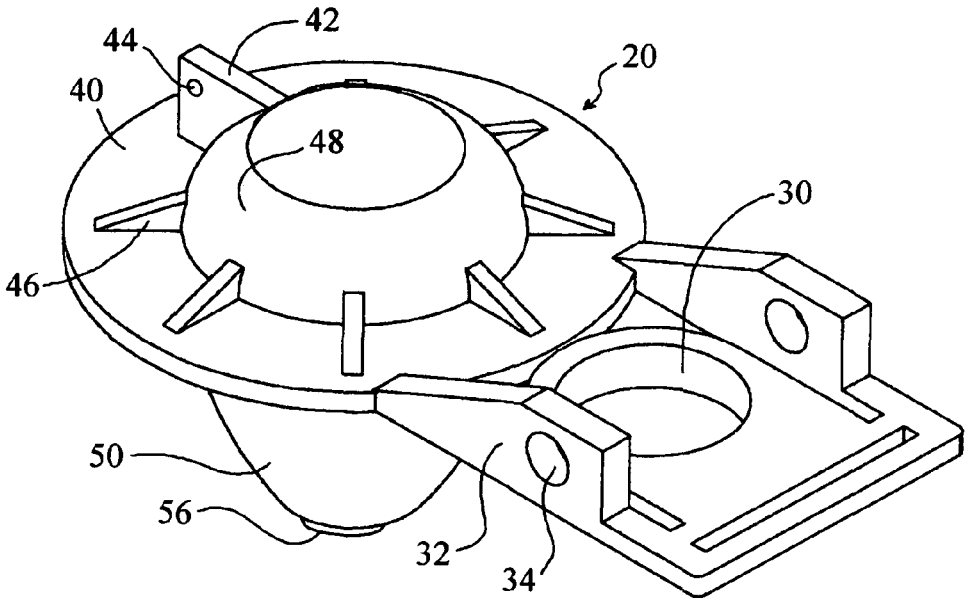
FIG. 1 is a top isometric view of the water-saving manual toilet flapper valve.
Figure 2:
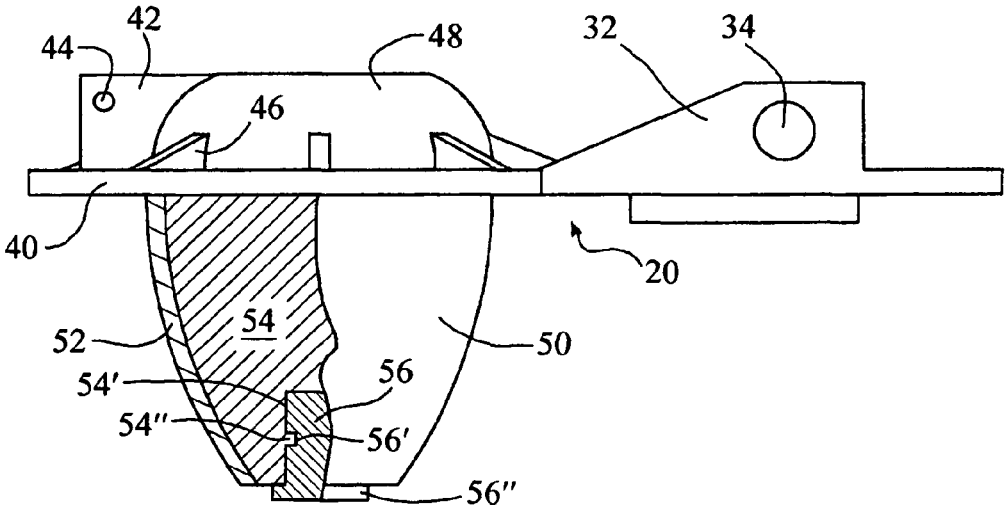
FIG. 2 is a side orthogonal view of the toilet flapper valve along with a partial cut-away view which exposes the solid inner core and the weighted mass.
Figure 3:
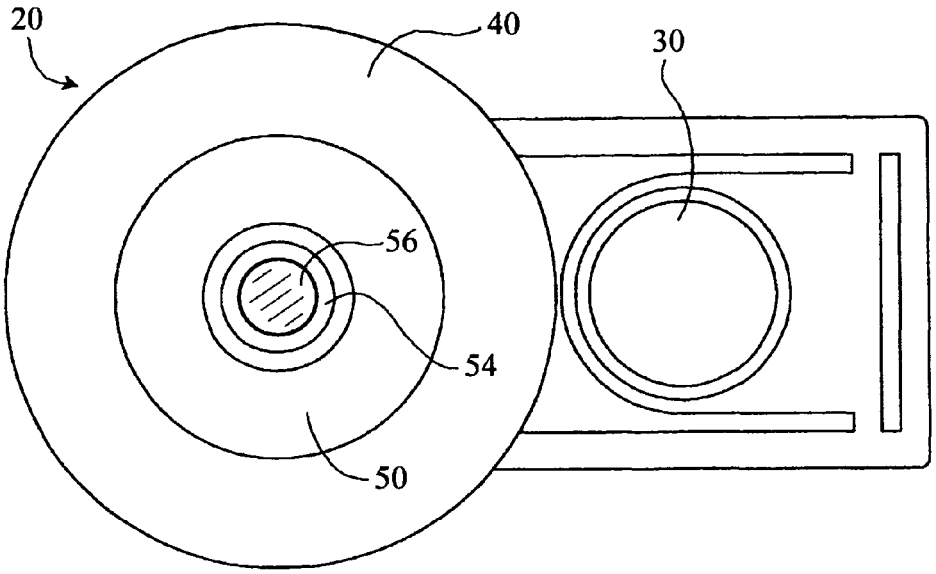
FIG. 3 is a bottom orthogonal view of the toilet flapper valve.
Figure 4:
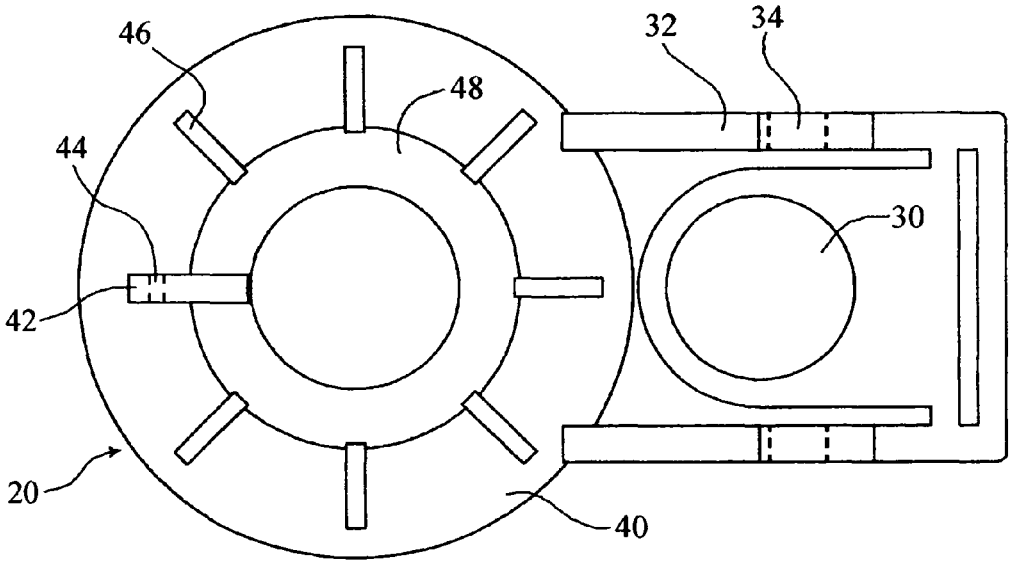
FIG. 4 is a top orthogonal view of the toilet flapper valve.
Figure 5:
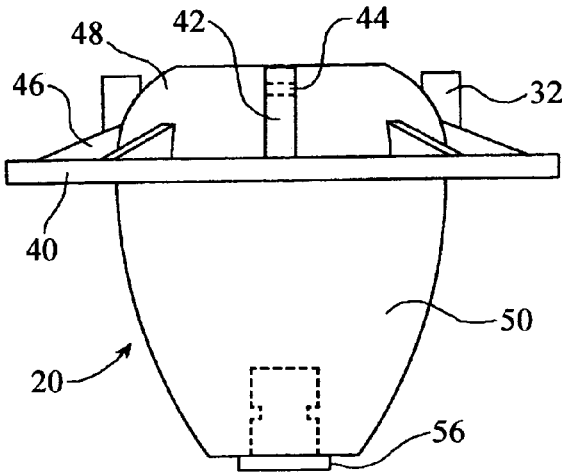
FIG. 5 is a front orthogonal view of the toilet flapper valve.

The water-saving manual toilet flapper valve 20 houses a solid inner core 54 and a weighted mass 56 within an outer shell 52 which forms an outer base or flange body 50 of the toilet flapper valve 20 (FIG. 2). The flange body defines a hollow inner space (FIG. 2). The weighted mass 56 is securely retained within the solid inner core 54, wherein the weighted mass 56 and the solid inner core 54 entirely occupy the hollow inner space of the flange body 50. The solid inner core 54 can be constructed of a dense rubber material or waterproof hydraulic cement and has a recess 54' formed therewithin. The weighted mass 56 can be constructed as a cylindrical brass piece with a groove 56' to allow the weighted mass 56 to be properly retained within the solid inner core 54 by a protrusion 54" formed in the inner wall of the recess 54'. As illustrated in FIG. 2, in the assembled configuration, the groove 56' engaged the protrusion 54" of said solid inner cord 54, and the weighted mass has a free end 56" extends outside of the hollow inner space of the flange body 50. The flange body 50 of the toilet flapper valve 20 is reinforced using radially extending reinforcing fins 46 attached to a raised top portion 48 and a rounded flat section 40 of the toilet flapper valve 20.

The solid inner core 54 and the weighted mass 56 prevent any air pockets from forming inside the flange body 50. This allows the toilet flapper valve 20 to become non-buoyant, allowing the toilet flapper valve to be manually operated with the toilet flush handle 72. The combined weight of the weighted mass 56 and solid inner core 54 allows the toilet flapper valve 20 to quickly sink and come to rest on a valve seat 68 (FIG. 6) when the toilet flush handle 72 is released. Thus, the toilet flapper valve 20 is to contain a specific gravity greater than that of water.

The water-saving toilet flapper valve 20 is designed to not leak when it is in the lowered position (FIG. 6). This is an improvement on other weighted toilet flapper valve designs since this improved toilet flapper valve 20 utilizes a flange design. This flange design is implemented as the flange body 50 of the toilet flapper valve 20. The toilet flapper valve 20 is also designed to allow the rounded flat section 40 of the toilet flapper valve 20 to extend past the diameter of the outlet pipe 64 (FIG. 6). The flange body 50 in conjunction with the rounded flat section 40 and the combined weight of the weighted mass 56 and solid inner core 54 give the toilet flapper valve 20 a leak-proof seal with the valve seat 68. Thus, the water-saving manual toilet flapper valve 20 rests on a valve seat 68 and makes a positive seal with the bottom of the toilet tank 60 with no water leakage (FIG. 6).

The water-saving manual toilet flapper valve 20 is designed to directly replace an existing toilet flapper valve installed in a conventional toilet flushing system 90 with no additional tools or modifications required. The toilet flapper valve 20 attaches to an overflow tube 82 (FIG. 6) by using one of two available attachment methods. The first attachment method involves securing the toilet flapper valve 20 to two protruding attachment pegs 80 located on each side of the base of the overflow tube 82. The toilet flapper valve 20 contains the means for attaching which further comprises a bored hole 34 located on each raised wing 32 (FIG. 1) which attach the toilet flapper valve 20 to the attachment pegs 80 (FIG. 6). In the second attaching method, the means for attaching further comprises a circular bore portion 30 (FIG. 1) which slides over the overflow tube 82. The second attachment method involves sliding the circular bore portion 30 of the toilet flapper valve 20 over the top of the overflow tube 82 to allow the toilet flapper valve 20 to rest at the bottom of the overflow tube 82 (FIG. 6).

Operation:

The operation of the water-saving manual toilet flapper valve is as follows:

1. The user depresses the toilet flush handle 72 to make the toilet flapper valve 20 rise in the upward position away from the valve seat 68. Either a partial toilet flush or a complete toilet flush can be achieved using the toilet flapper valve 20. The toilet flush handle 72 must remain depressed for the amount of time necessary to allow for either a partial or full flush.
2. The user releases the toilet flush handle 72 once the desired toilet flush is achieved. The combined weight of the weighted mass 56 and solid inner core 54 allows the toilet flapper valve 20 to quickly drop down toward the valve seat 68. The rounded flat section 40 and flange body 50 of the toilet flapper valve 20 will then create a positive seal with the top of the valve seat 68 (FIG. 6). This creates a leak-proof seal at the valve seat 68, stopping the release of water from the toilet tank 60 into the toilet bowl (not shown). Water is then replenished into the toilet tank 60 via the toilet flushing system 90.

Thus, the addition of the flange body 50, weighted mass 56, and solid inner core 54 allow the toilet flapper valve 20 to obtain a positive seal that is free from water leakage. In addition, the reinforcing fins 46 allow the rounded flat section 40 of the toilet flapper valve 20 to remain flat which prevents warping. Thus, the toilet flapper valve 20 is able to solve the problems of water leakage and warping, which many prior-art weighted toilet flapper valves have previously experienced. In addition, a user of the toilet flapper valve 20 has the added benefit of conserving water with each flush of the toilet.

CONCLUSIONS, RAMIFICATIONS AND SCOPE

Accordingly, the reader will see that the aforementioned embodiment of the water-saving manual toilet flapper valve provides an efficient water-saving, yet economical device that can be installed by anyone without the need of additional tools or modifications. The water-saving manual toilet flapper valve will save millions of gallons of good clean water from being unnecessarily flushed away each time he or she flushes the toilet. The water usage of conventional toilets has been known to be the biggest water waster in the home. Saving this excess amount of water used by the toilet is critical especially these days with water shortages, drought, and rising costs of water around the world. It will also prevent unnecessary water from filling septic tanks and sewer systems, thus preserving natural water resources and greatly lowering pollution. This improved toilet flapper valve will also allow users to save money on their water bill and septic tank owners will save thousands on septic tank maintenance. The water-saving manual toilet flapper valve is designed to always create a positive seal which will never leak or warp. It is the perfect solution to saving money and water resources in consumer homes or offices.

Although the description above contains many specificities, these should not be construed as limitations on the scope of the embodiment but rather as an exemplification of the presently preferred embodiment. Many other variations are possible. For example, the solid inner core of the toilet flapper valve can be made of different materials such as a dense rubber material; the reinforcing fins can be modified in size, shape, or quantity; the weighted mass can have different shapes, sizes, and can be made of different materials other than brass; the weighted mass can be integrated into the solid inner core in a different manner; the weighted mass can be eliminated in favor of a solid inner core material that is of similar combined weight of the weighted mass and solid inner core, etc.

Thus, the scope of the embodiment should be determined by the appended claims and their legal equivalents, rather than by the examples given.

We claim:

1. A water-saving toilet flapper valve comprising of:

a) a rounded flat section that is centrally positioned over a valve seat of a toilet tank and is radially extended beyond the diameter of said valve seat, b) an outer shell forming a flange body that is downwardly extended from said rounded flat section, said flange body of said water-saving toilet flapper valve is reinforced using radially extending reinforcing fins attached to a raised top portion and said rounded flat section of said toilet flapper valve, said flange body defines a hollow inner space, c) a solid inner core retained securely within said hollow inner space of said flange body whereby said solid inner core gives added weight to said toilet flapper valve and the interfacing of said rounded flat section and said flange body with said valve seat produces a positive seal, said solid inner core further comprises a protrusion formed in the inner wall of said recess, d) means for attaching said toilet flapper valve to an existing toilet flushing system including attaching said toilet flapper valve to a toilet flush handle and an overflow tube, whereby depressing said toilet flush handle causes said toilet flapper valve to raise and begin a flushing cycle, and d) a weighted mass retained securely within and by said solid inner core, said weighted mass gives additional weight to said toilet flapper valve, said weight mass comprises a cylindrical brass piece with a groove formed therein, wherein in the assembled configuration, said groove engaged said protrusion of said solid inner cord thereby allowing said weighted mass to be securely retained within and by said solid inner core, and said weighted mass has a free end extends outside of said hollow inner space of the flange body, wherein said solid inner core and said weighted mass entirely occupy said hollow inner space of said flange body, wherein said solid inner core comprises a dense airproof and waterproof hydraulic cement, wherein said solid inner core in conjunction with said weighted mass prevent any air pockets from forming inside said outer shell of said flange body and give the toilet flapper valve non-buoyancy and a combined weight, wherein said combined weight allows said toilet flapper valve to be manually operated with said toilet flush handle and allows said toilet flapper valve to quickly sink and come to rest on said valve seat when said toilet flush handle is released.

* * * * *